US010352131B2

(12) United States Patent
Dockweiler

(10) Patent No.: US 10,352,131 B2
(45) Date of Patent: Jul. 16, 2019

(54) VALVE FOR USE WITH DOWNHOLE TOOLS

(71) Applicant: HALLIBURTON ENERGY SERVICES, INC., Houston, TX (US)

(72) Inventor: David Allen Dockweiler, Prosper, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 215 days.

(21) Appl. No.: 15/518,037

(22) PCT Filed: Dec. 17, 2014

(86) PCT No.: PCT/US2014/070833
§ 371 (c)(1),
(2) Date: Apr. 10, 2017

(87) PCT Pub. No.: WO2016/099485
PCT Pub. Date: Jun. 23, 2016

(65) Prior Publication Data

US 2017/0306723 A1 Oct. 26, 2017

(51) Int. Cl.

| | |
|---|---|
| ***E21B 34/14*** | (2006.01) |
| ***E21B 34/06*** | (2006.01) |
| ***E21B 33/12*** | (2006.01) |
| *E21B 34/00* | (2006.01) |

(52) U.S. Cl.
CPC ..... *E21B 34/14* (2013.01); *E21B 33/12* (2013.01); *E21B 34/06* (2013.01); *E21B 2034/002* (2013.01)

(58) Field of Classification Search
CPC .... E21B 2034/002; E21B 33/12; E21B 34/06; E21B 34/14; E21B 34/10
See application file for complete search history.

(56) References Cited

U.S. PATENT DOCUMENTS

| | | | | |
|---|---|---|---|---|
| 3,901,315 | A | 8/1975 | Parker et al. | |
| 4,212,355 | A | 7/1980 | Reardon | |
| 4,738,431 | A | 4/1988 | Perkins | |
| 4,967,844 | A | 11/1990 | Brooks et al. | |
| 2002/0066573 | A1* | 6/2002 | Patel | E21B 34/10 166/374 |

(Continued)

FOREIGN PATENT DOCUMENTS

| | | | |
|---|---|---|---|
| WO | 2000015943 | A1 | 3/2000 |
| WO | 2008060891 | A2 | 5/2008 |

OTHER PUBLICATIONS

International Search Report dated Aug. 19, 2015, issued in corresponding PCT Application No. PCT/US2014/070833.

(Continued)

*Primary Examiner* — Caroline N Butcher
(74) *Attorney, Agent, or Firm* — McAfee & Taft

(57) ABSTRACT

An apparatus and method relating to down-hole production equipment for use in an oil well environment is provided. The apparatus and method are for selectively isolating fluid flow through a production packer or other down-hole tubular device. The apparatus and method use a ball valve, which is moved from an open position to a closed position by lateral or axial movement of the tubing string as opposed to by rotating the tubing string.

20 Claims, 14 Drawing Sheets

(56) References Cited

U.S. PATENT DOCUMENTS

2012/0298901 A1* 11/2012 Ringgenberg ..... E21B 34/06
251/313
2013/0105172 A1* 5/2013 Swenson ..... E21B 23/006
166/370

OTHER PUBLICATIONS

Written Opinion dated Aug. 19, 2015 issued in corresponding PCT Application No. PCT/US2014/070833.
Office Action dated Jan. 11, 2018, issued in corresponding Canadian Patent Application 2,963,238.

* cited by examiner

VALVE FOR USE WITH DOWNHOLE TOOLS

FIELD

This disclosure relates to down-hole production equipment for use in an oil well environment for selectively isolating fluid flow through a production packer or other down-hole tubular device. More particularly, this disclosure relates to a system and method utilizing a selectively operable valve.

BACKGROUND

Various oil and gas production operations use ball valves. Often packers are used in conjunction with ball valves. The packer closes off the annulus between the tubing string and the well bore or casing. The ball valve can selectively close off the central flow passage of the tubing string such that flow is or is not allowed through the passageway depending on the setting of the ball valve.

The ball valves of the prior art generally disclose use of a spherical ball-valve element, which in a closed valve position has seals, which seal or close off the central flow passageway of the tubing string so that the valve element will seal against pressure in one or both directions. Typically, rotation of the tubing string is used to operate the valve element to move it between open and closed positions. However, rotation is also used to operate other down-hole tools that can be used in conjunction with the ball valve; thus, requiring sequential rotative operations without a positive indication that the valve is fully closed. In addition, in highly deviated well bores, it can be difficult to achieve rotation to set, unset, open or close down-hole tools.

DETAILED DESCRIPTION

Figure 1:
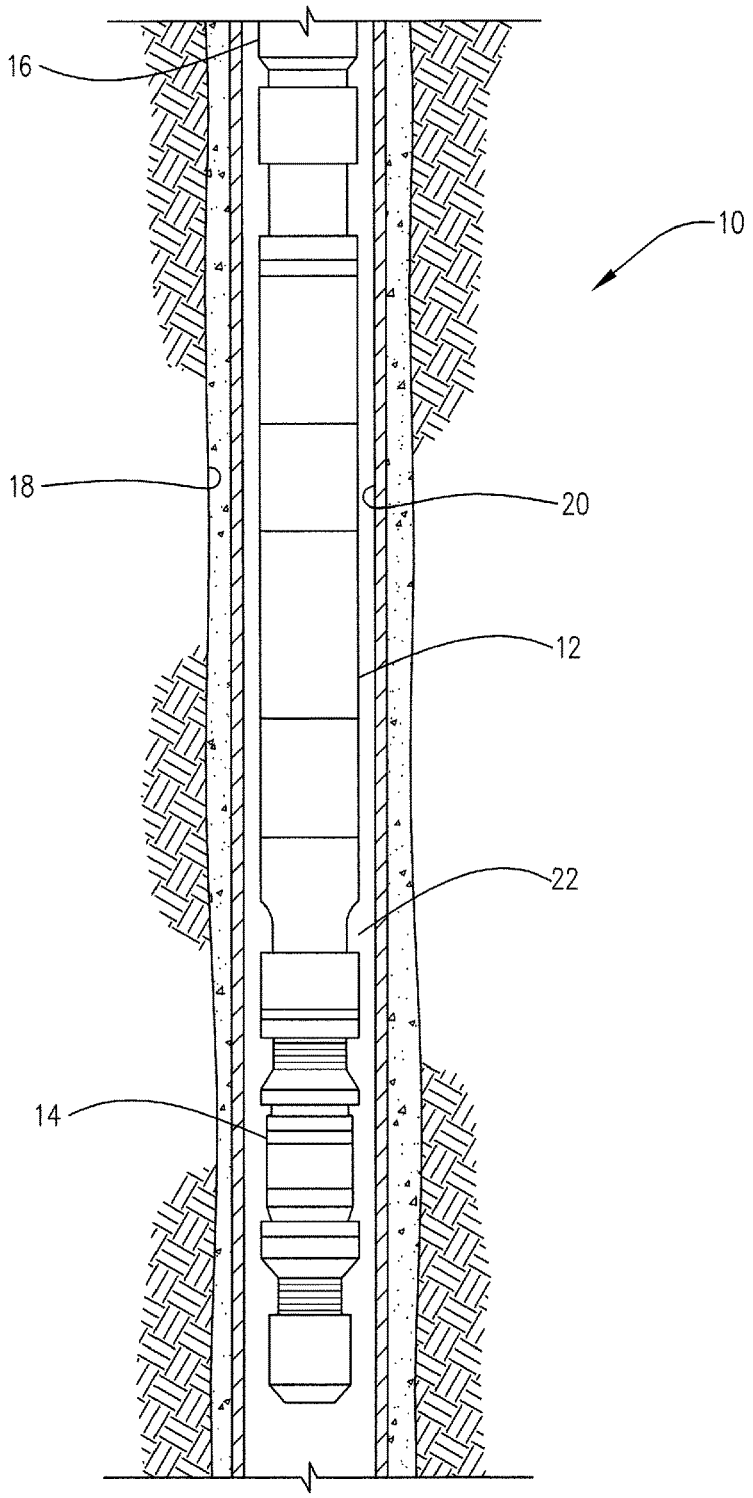
FIG. 1 is a schematic view of a down-hole tool lowered into a well

Referring now to the drawings, wherein like reference numbers are used herein to designate like elements throughout the various views and various embodiments, which are illustrated and described. The figures are not necessarily drawn to scale, and in some instances the drawings have been exaggerated and/or simplified in places for illustrative purposes only. In the following description, the terms "upper," "upward," "up-hole," "lower," "downward," "below," "down-hole" and the like, as used herein, shall mean: in relation to the bottom or furthest extent of the surrounding wellbore even though the well or portions of it may be deviated or horizontal. The terms "inwardly" and "outwardly" are directions toward and away from, respectively, the geometric center of a referenced object. Where components of relatively well-known designs are employed, their structure and operation will not be described in detail. One of ordinary skill in the art will appreciate the many possible applications and variations of the present invention based on the following description.

Referring now to FIG. 1, a down-hole tool 10 incorporating the invention is illustrated. Down-hole tool 10 comprises a valve system. As illustrated the valve system is a ball-valve system 12. Additionally, the valve system may contain one or more other tools, such as packer 14 and tubing 16. As illustrated, down-hole tool 10 is in a well bore 18 having a casing 20. An annulus 22 is formed between down-hole tool 10 and casing 20. A packer 14 prevents flow through the annulus 22 and anchors down-hole tool 10 in the wellbore, as is known in the art. The packer is shown in an unexpanded position in FIG. 1.

Figure 2:
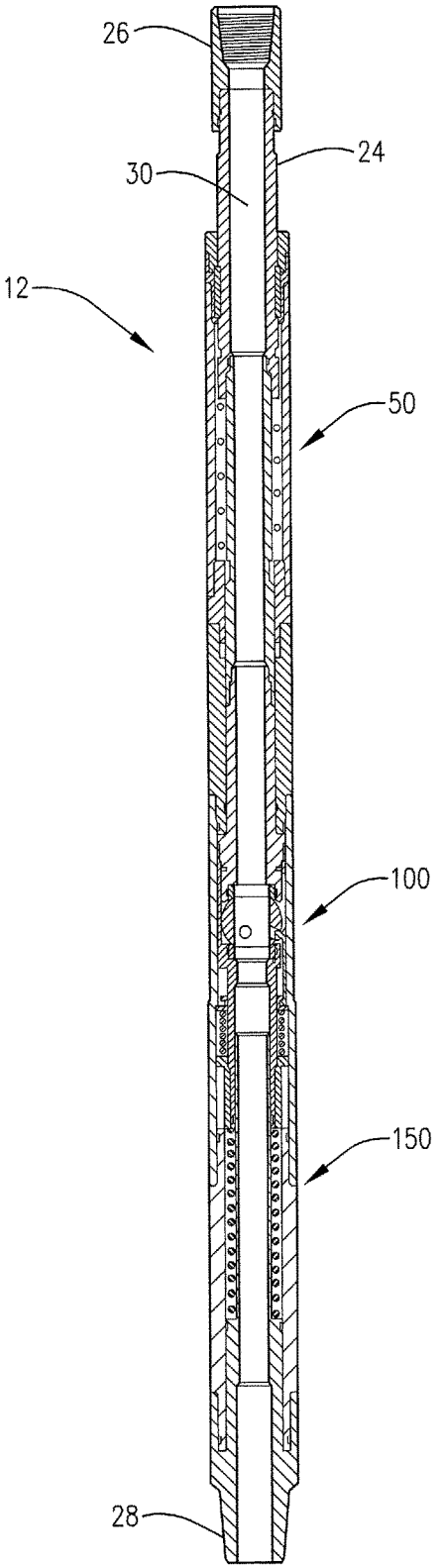
FIG. 2 is a cross-sectional schematic view of a ball-valve system in accordance with a first embodiment.
Figure 3:
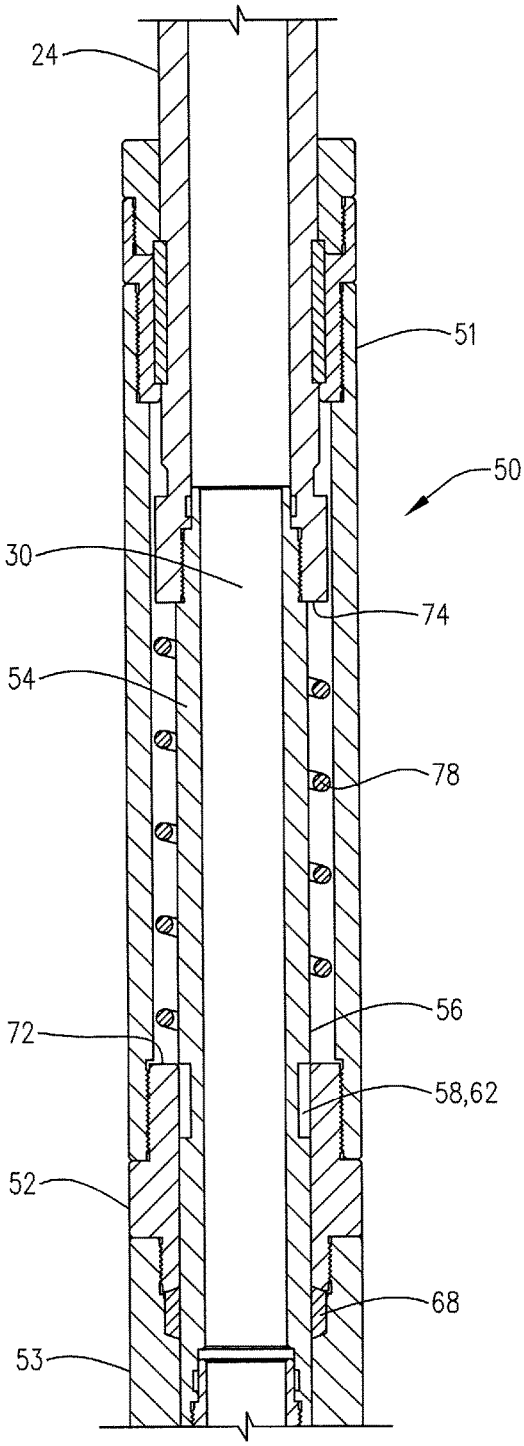
FIG. 3 is an enlargement of actuator section of the ball-valve system illustrated in FIG. 2.

Turning now to FIG. 2, a cross-sectional view of ball-valve system 12 is illustrated. Ball-valve system 12 comprises a tubular supporting mandrel 24, which has an upper end 26 adapted to couple to a string of pipe or tubing, or to another down-hole tool. The lower end 28 of ball-valve system 12 is also adapted to couple to tubing or another down-hole tool, such as packer 14 illustrated in FIG. 1. Mandrel 24 defines a central flow passageway 30, which lies upon the longitudinal axis of down-hole tool 10. As used herein, longitudinal or axial refers to the long axis of mandrel 24 extending up-hole to down-hole.

Ball-valve system 12 generally comprises an actuator section 50, a ball-valve section 100 and a balancing piston section 150. FIGS. 3-6 illustrate one embodiment of the actuator system 50. The actuator system 50 of FIGS. 3-6 comprises a portion of mandrel 24 and an outer sleeve 51. Outer sleeve 51 is positioned concentrically about mandrel 24 and may comprise one or more sleeve portions connected together. Mandrel 24 and outer sleeve 51 are in sliding relation so that an axial force on mandrel 24 will cause it to slide longitudinally in relation to outer sleeve 51. Further, this sliding relation is resilient due to spring elements as further described below. Mandrel 24 has an uppermost position relative to sleeve 51 wherein spring 78 is fully expanded under the weight of mandrel 24. Mandrel 24 has a lowermost position defined wherein spring 78 is compressed. The compression is limited by the movement of a lug in a straight leg channel, described below.

Figure 4:
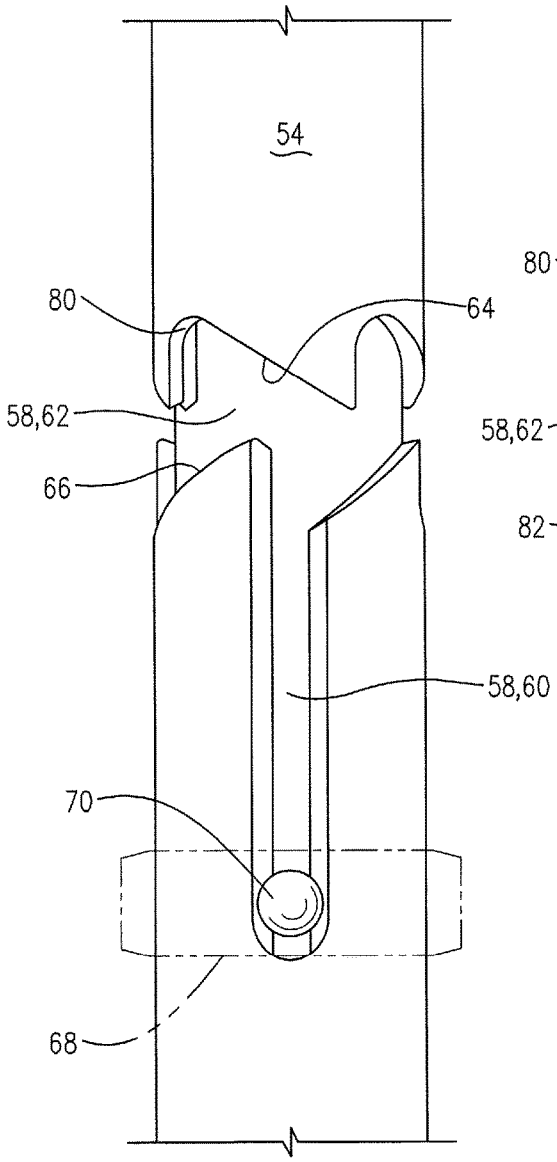
FIGS. 4, 5 and 6 are isometric figures illustrating the movement of the actuating section of the ball-valve system of FIG. 2.

Actuator section 50 further comprises a tubular member 54 and a ring 68. As shown, tubular member 54 can be a portion of mandrel 24. Tubular member 54 has a channel 58 on its outer surface 56. Channel 58 comprises a straight leg section 60 and a circumferential section 62. Straight leg section 60 extends substantially longitudinally along the surface of tubular member 54, as shown in FIG. 4. Circumferential section 62 extends circumferentially about tubular member 54. Circumferential section 62 has an upper or up-hole surface 64 and a lower or down-hole surface 66. Each surface 64 and 66 has a saw tooth configuration.

A ring 68 is positioned around tubular member 54. Ring 68 is secured against longitudinal movement by coupling Coupling 52 and sleeve portion 53 but slidingly engages Coupling 52 and sleeve portion 53. Additionally, ring 68 slidingly engages mandrel 24 and its tubular member 54. Thus, ring 68 can rotate about the longitudinal axis of mandrel 24. Ring 68 has a lug 70 extending inward into channel 58. Lug 70 can be a fixed protuberance on the inner surface of ring 68 or can be a trapped ball bearing.

Movement of mandrel 24 and its tubular member 54 is resiliently controlled by a spring 78 radially positioned between mandrel 24 and outer sleeve 51. Further, spring 78 is longitudinally sandwiched between an outward extending shoulder 74 of mandrel 24 and an inward extending shoulder 72 of upper outer sleeve 51. Coupling 52 forms inward extending shoulder 72. Coupling 52 is part of outer sleeve 51. Additionally, sleeve portion 53 of outer sleeve 51 is connected to Coupling 52 and ring 68 is longitudinally sandwiched between them.

Figure 5:
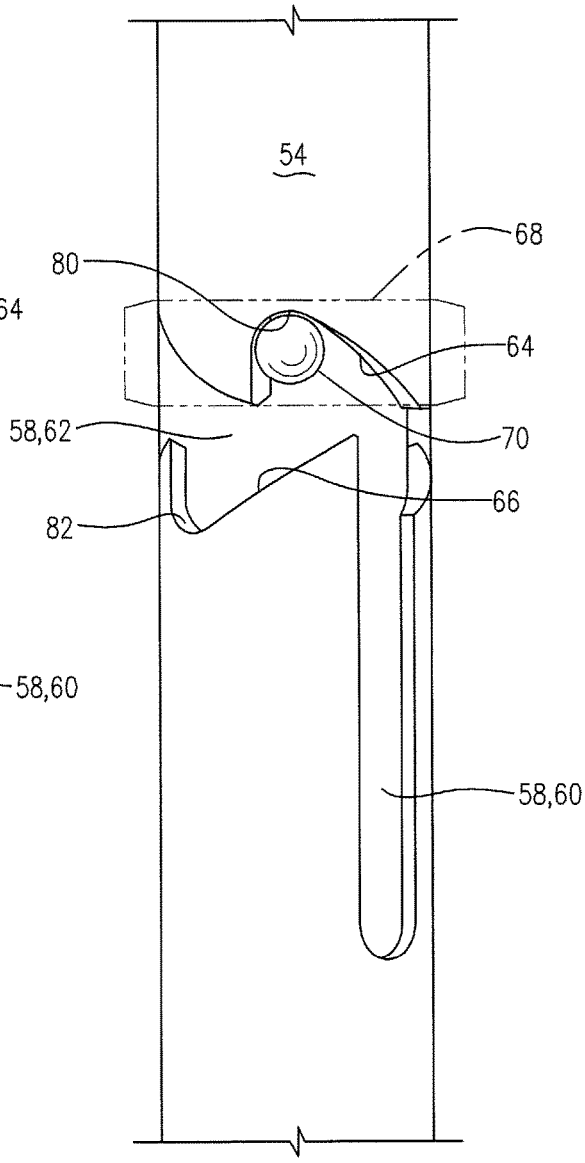
Figure 6:
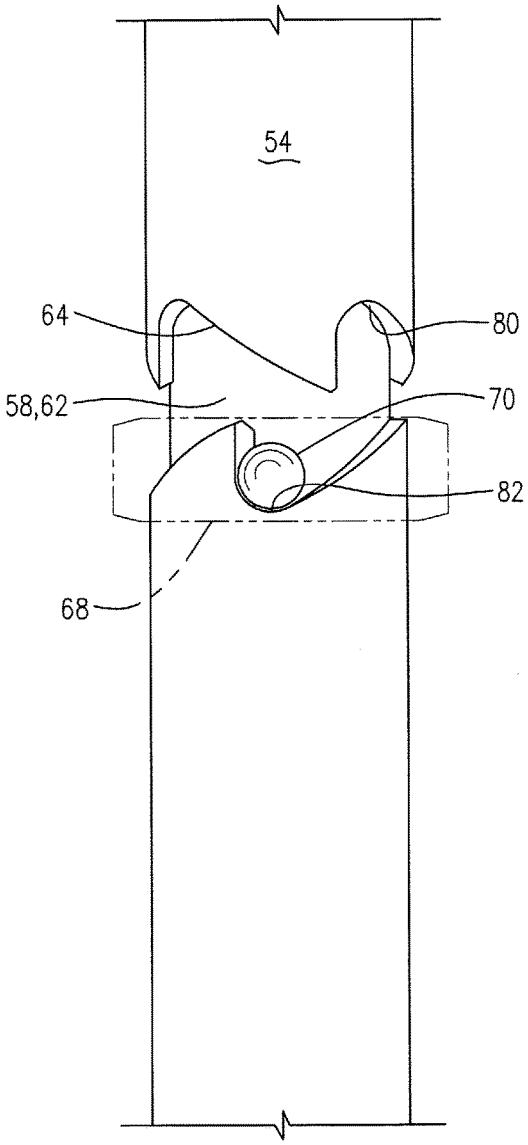

When mandrel 24 slides longitudinally down-hole relative to outer sleeve 51, spring 78 is compressed, thus, biasing mandrel 24 and tubular member 54 in an up-hole direction. As can be seen from FIG. 4, when lug 70 is positioned in straight leg section 60 and no axial force is applied to mandrel 24, lug 70 will be in the down-hole most position of straight leg section 60 due to the biasing effect of spring 78. When sufficient axial force is applied to mandrel 24, mandrel 24 will slide in relation to ring 68; thus, positioning lug 70 against upper surface 64. Continued axial force, will cause ring 68 to rotate due to the saw tooth shape of upper surface 64. The rotation places lug 70 in a crest 80 of upper surface 64, as shown in FIG. 5. Releasing the axial force will cause mandrel 24 to slide longitudinally upward due to the biasing of spring 78; thus, lug 70 will contact lower surface 66 causing ring 68 to rotate due to the saw tooth shape of lower surface 66. The rotation places lug 70 in a trough 82 of lower surface 66, as shown in FIG. 6.

Figure 7:
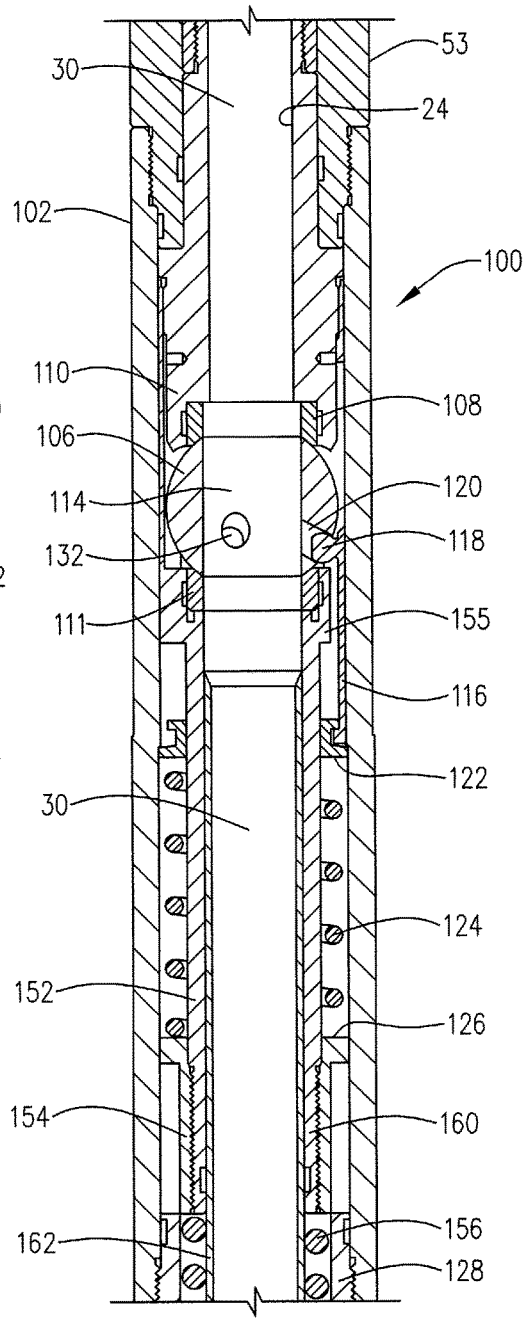
FIG. 7 is an enlargement of the ball-valve section of the ball-valve system illustrated in FIG. 2. The ball-valve system is shown allowing flow through the central passageway.

Turning now to FIG. 7, the ball-valve section 100 of ball-valve system 12 is illustrated. Ball-valve section 100 includes sleeve portion 102 of outer sleeve 51. Sleeve portion 102 is connected to sleeve portion 53 in fixed relation. Within sleeve portion 102 is a portion of mandrel 24, balancing piston 152 and ball-valve element 106. Ball-valve element 106 is positioned between mandrel 24 and balancing piston 152. A first or top ball seat 108 is positioned between end 110 of mandrel 24 and ball-valve element 106 to provide sealing engagement and prevent fluid flow from central flow passageway 30 through the junction of end 110 and ball-valve element 106. Similarly, a second or bottom ball seat 111 is positioned between end 155 of balancing piston 152 and ball-valve element 106 to provide sealing engagement and prevent fluid flow from central flow passageway 30 through the junction of end 155 and ball-valve element 106. First and second ball seats 108 and 111 can be metal seats that provide a sealing engagement with ball-valve element 106.

Ball valve element 106 has spherical surface portions, which can be sealed against pressure in either direction in a closed condition of the valve, as further described below. Ball-valve element 106 is rotatable about a rotational axis transverse to the longitudinal axis of down-hole tool 10. Ball-valve element 106 has a flow opening or passage 114 that extends there through. In a first rotative position or open position, flow opening 114 is aligned with central flow passageway 30, thus allowing flow through central flow passageway 30. In a second rotative position or closed position, flow opening 114 is transverse to central flow passageway 30, thus preventing flow through central flow passageway 30.

Operating arm 116 controls the rotation of ball-valve element 106. At one end, operating arm has a lug 118. Ball-valve element 106 and operating arm 116 are attached by positioning lug 118 in an orifice 120. A retainer 122 traps a second end of operating arm 116. Operating arm 116 and retainer 122 are positioned between sleeve portion 102 and balancing piston 152. Retainer 122 slidingly engages sleeve portion 102 and balancing piston 152. The engagement is resilient and biased by spring 124 in an up-hole direction. Spring 124 is braced on the down-hole side by a shoulder 126 formed by ring portion 154 of balancing piston 152.

Figure 9:
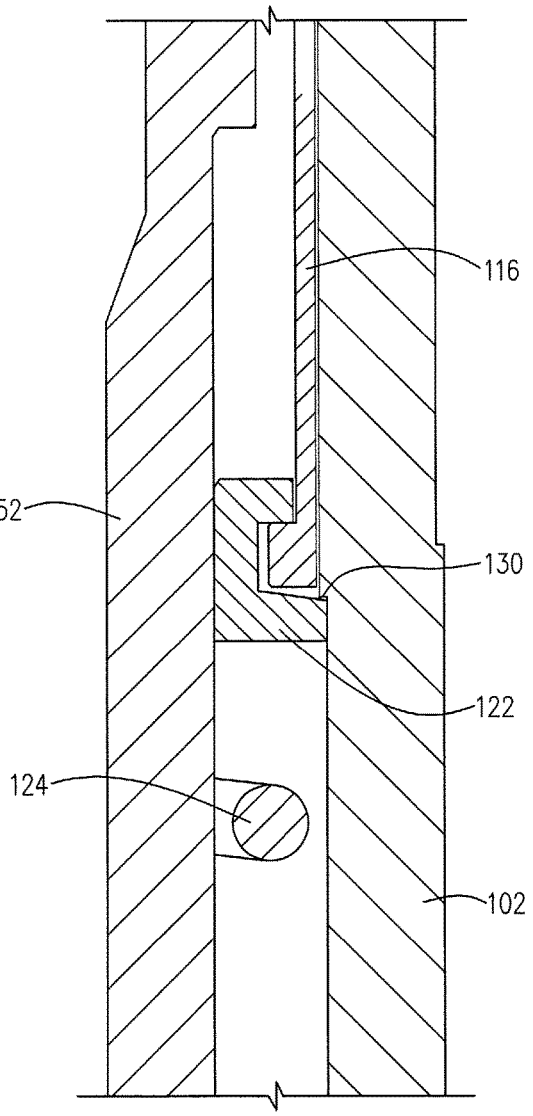
FIG. 9 is an enlargement of a portion of the operating arm of the ball-valve section of the ball-valve system illustrated in FIG. 2.

Thus, retainer 122 is resiliently restrained from down-hole movement by spring 124. Additionally, retainer 122 is limited in up-hole movement by an offset or shoulder 130, best seen from FIG. 9.

As will be realized from an examination of FIG. 7, longitudinal movement of mandrel 24 in a down-hole direction will cause ball-valve element 106 to move down-hole. While operating arm 116 will also move down-hole as a result, its movement is resiliently restrained by spring 124; thus, it will create an upward force on one side of ball-valve element 106 by its connection at orifice 120. The upward force causes ball-valve element 106 to rotate from an open position to a closed position. Similarly, from a closed position, upward movement of ball-valve element 106 will result in operating arm 116 rotating ball-valve element 106 from the close position to the open position.

More than one operating arm can be attached to ball-valve element 106; thus, as illustrated, there is a second orifice 132 by which a second operating arm can be attached.

Figure 8:
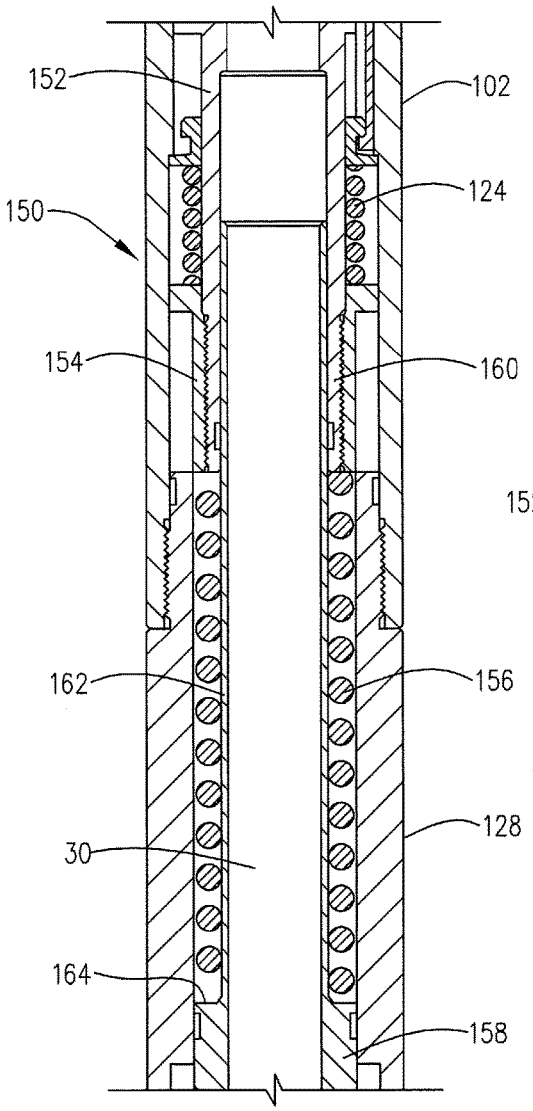
FIG. 8 is an enlargement of the balancing piston section of the ball-valve system illustrated in FIG. 2.

Turning now to FIG. 8, balancing piston section 150 is illustrated. Balancing piston section 150 comprises sleeve portions 102 and 128 of outer sleeve 51, balancing piston 152, spring 156 and lower mandrel 158. The lower portion 160 of balancing piston 152 is between the upper portion 162 of lower mandrel 158 and sleeve portion 102. Upper portion 162 and sleeve portion 102 slidingly receive balancing piston 152 so that balancing piston 152 can move longitudinally up and down-hole. Balancing piston 152 resiliently slides and is upwardly biased by spring 156. Spring 156 is sandwiched between upper portion 162 of lower mandrel 158 and sleeve portion 128. At its lower end, spring 156 is braced by a shoulder 164 formed on lower mandrel 158.

Accordingly, balancing piston 152 can move downward when mandrel 24 and ball-valve element 106 move down-hole and can return upward when they return up-hole. Additionally, at all times balancing piston 152 is biased upward, and thus asserts pressure on ball-valve element 106 to maintain the seal of ball seats 108 and 111, and to prevent pressure down-hole of the ball valve from rotating ball-valve element 106 to an unwanted position. Additionally, when pressure up-hole of the ball valve is greater than the pressure down-hole of the ball, fluid from up-hole can seep into ball-valve element 106 to prevent the ball valve from being forced into rotation by the up-hole pressure.

With reference now to FIGS. 7 and 10-14, the operation of the down-hole tool will be further described. The ball valve element 106 being initially in the first rotative position shown in FIGS. 7 and 12, allows flow through central flow passage 30 defined up-hole of ball valve element 106 by mandrel 24 and down-hole of ball-valve element 106 by balancing piston 152 and lower mandrel 158. In this position, mandrel 24 is in its upmost longitudinal position and lug 70 is at the bottom of straight leg section 60. Because mandrel 24 is biased upwardly by spring 78, ball-valve element 106 is locked in the first rotative state until a predetermine force is applied to mandrel 24 to overcome spring 78 sufficiently to move ball-valve element 106 to the second rotative state.

Downward longitudinal force on mandrel 24 moves ball valve element 106 to its second rotative position. Typically, the downward longitudinal force or axial force will be exerted upon the mandrel by tubing string or tubing 16 attached to the upper end 26 of mandrel 24. The axial force is applied by moving tubing 16 in a down-hole direction in the well bore. Tubing 16 then asserts the axial force on mandrel 24. A packer 14 or another down-hole tool is attached to lower end 28 and is anchored in well bore 18 so as to prevent outer sleeve 51 from moving down-hole with mandrel 24 when the axial force is exerted.

Figure 10:
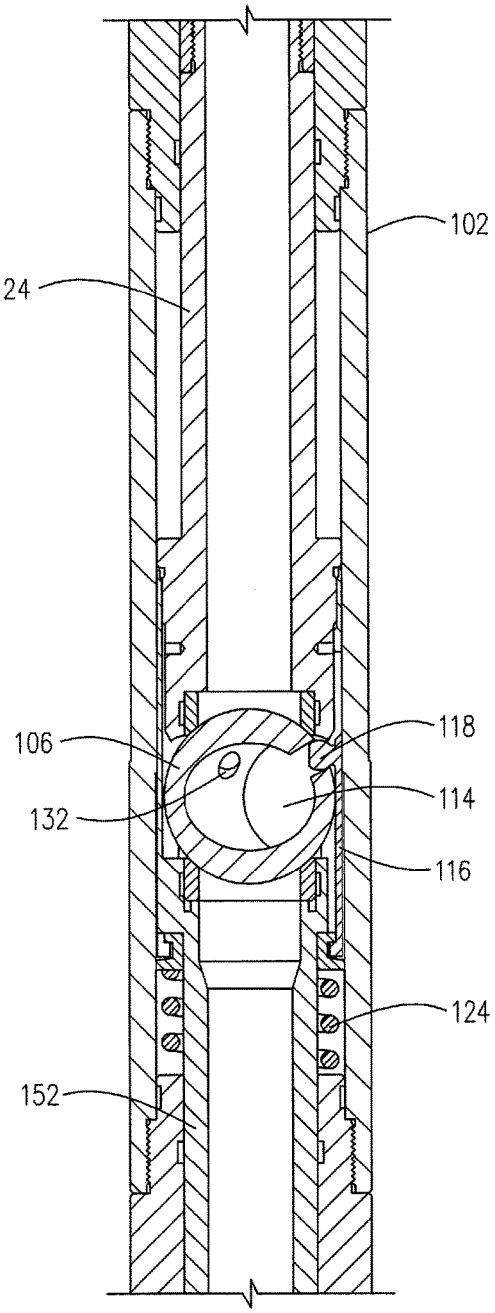
FIG. 10 illustrates the ball-valve section of FIG. 7 with the ball valve moved to a position where flow in the central passageway is prevented.
Figure 13:
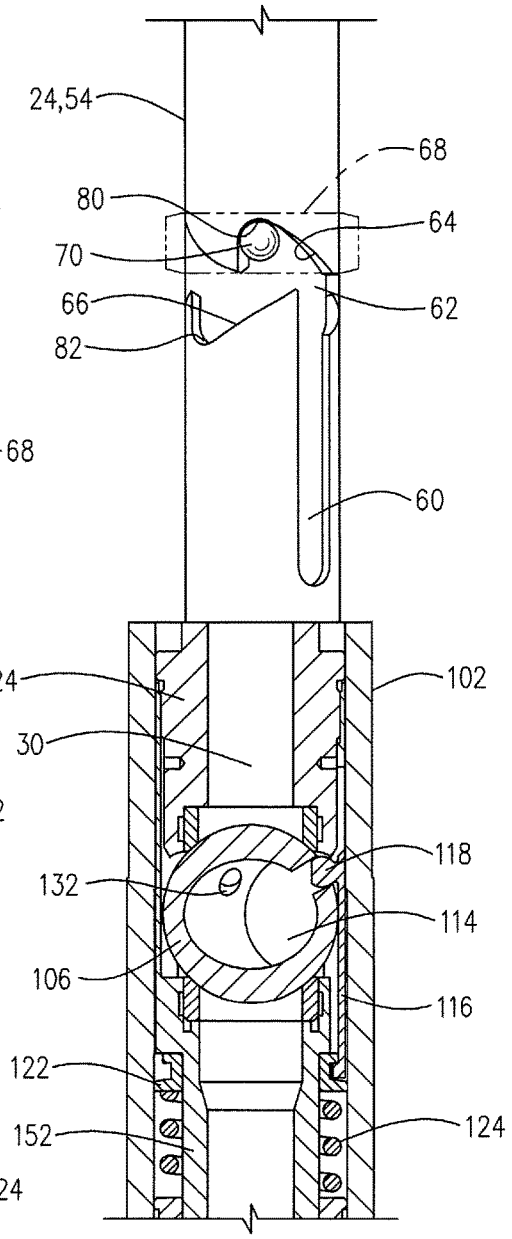

As shown in FIGS. 10 and 13, under this axial force mandrel 24 moves relative to sleeve 51 and moves downward until lug 70 comes in contact with upper surface 64 of circumferential section 62. The downward movement of mandrel 24 transfers the downward force to ball-valve element 106, thus moving it downward. Downward force asserted by ball-valve element 106 on operating arm 116 is at least partially countered by spring 124 so that operating arm 116 moves ball-valve element 106 to its second rotative position preventing flow through central flow passageway 30. Downward force is also asserted by ball-valve element 106 on balancing piston 152. Spring 156 allows balancing piston 152 to move downward with ball-valve element 106 while still maintaining upward pressure such that ball seats 108 and 111 maintain a fluid tight seal, hence prevention fluid in central flow passageway 30 from circumventing ball-valve element 106.

As explained above, contact of lug 70 with upper surface 64 causes ring 68 to rotate until lug 70 is in crest 80. Subsequently, the longitudinal force is released causing mandrel 24 to move upward. However, because lug 70 now moves into contact with lower surface 66 of circumferential section 62, mandrel 24 does not return to its uppermost position relative to sleeve 51; thus, ball-valve element 106 remains in the second rotative position. Contact of lug 70 with lower surface 66 causes ring 68 to rotate until lug 70 is in trough 82 locking ring 68 from further rotation without application of further downward longitudinal force. Thus, ball-valve element is now locked in the second rotative position as best seen in FIGS. 11 and 14.

Figure 11:
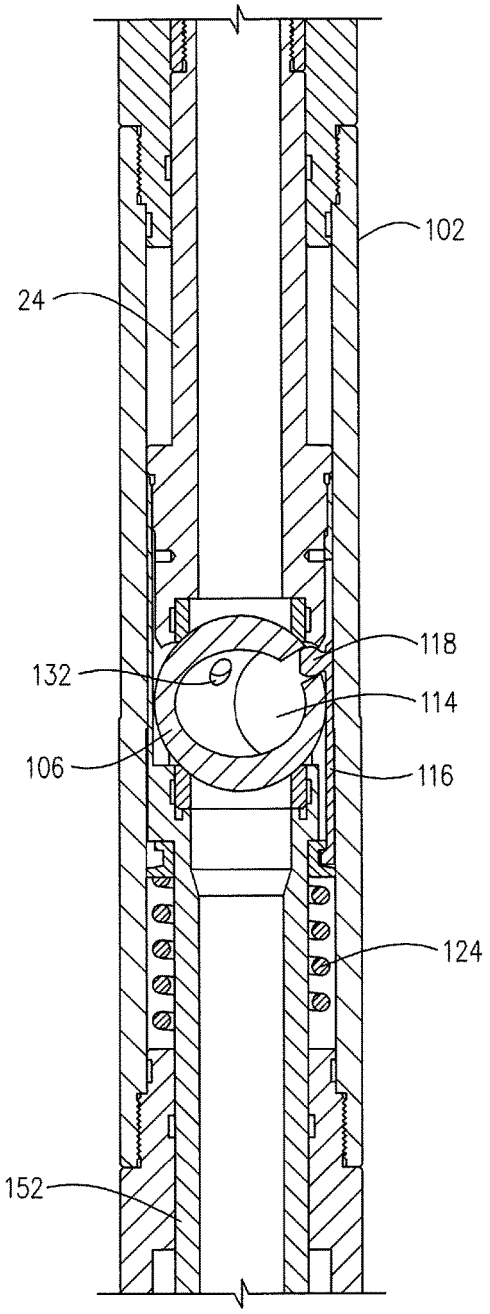
FIG. 11 illustrates the ball-valve section of FIG. 7 with the ball valve locked in a position where flow in the central passageway is prevented.
Figure 12:
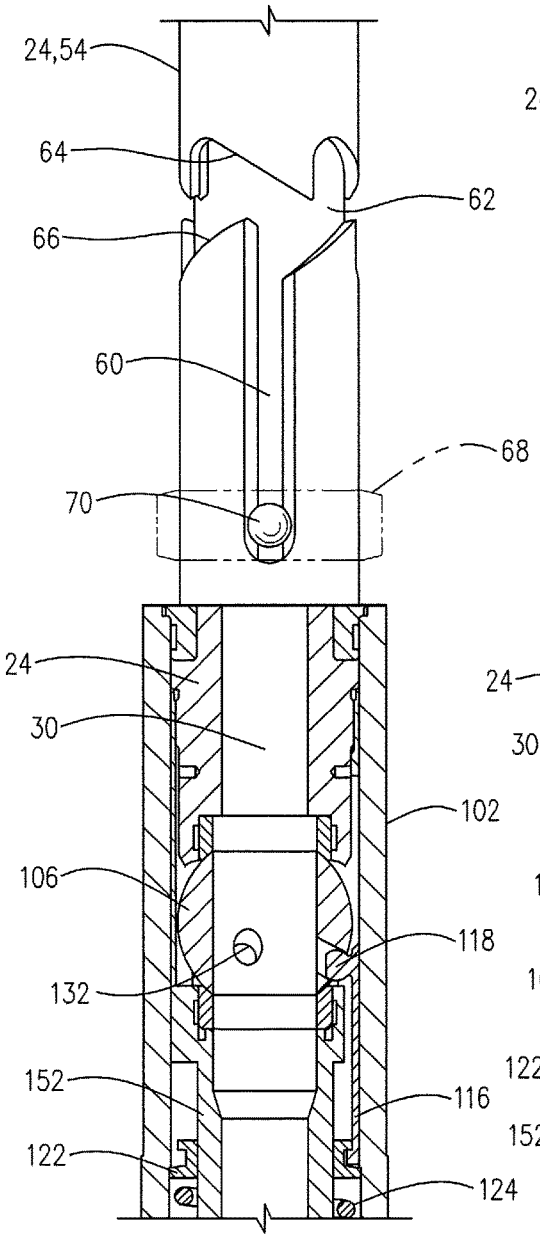
FIGS. 12, 13 and 14 are partial isometric and partial cross-sectional views illustrating the interaction of the actuator section and ball-valve sections. The isometric portion is shown without the outer sleeve.
Figure 14:
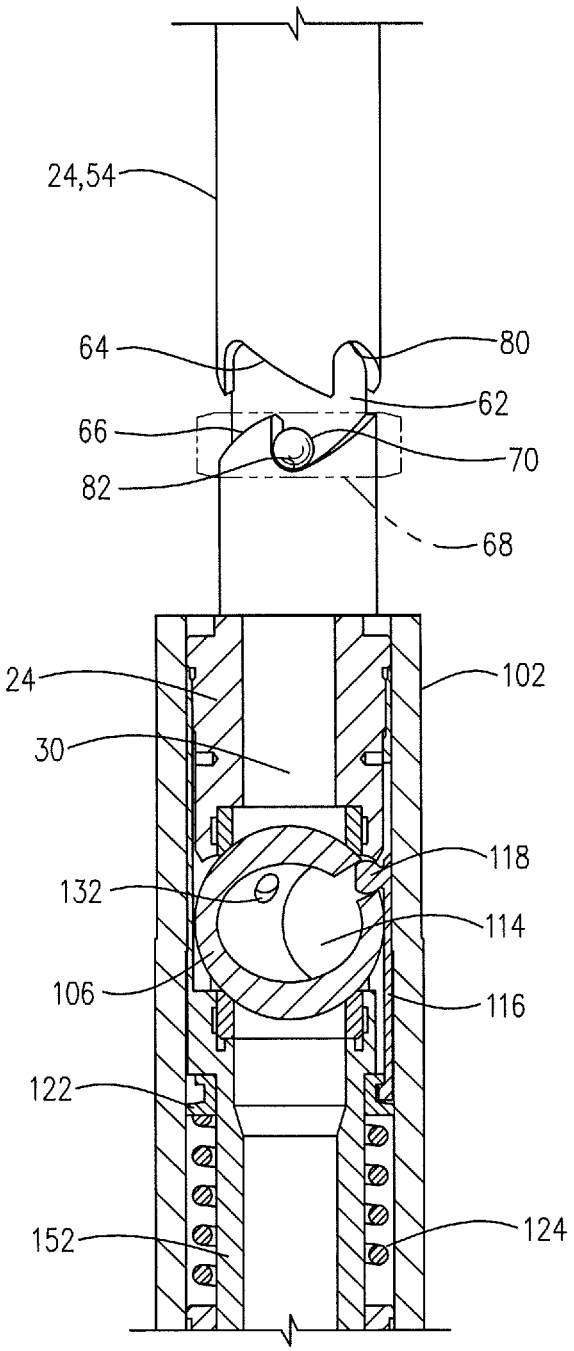

As will be noted from FIGS. 11 and 14, balancing piston 152 allows limited movement of ball-valve element 106 away from first ball seat 108 when up-hole pressure from the ball-valve element is greater than down-hole pressure from the ball-valve element. Thus, fluid from up-hole can enter flow opening 114. This allows the pressure within ball-valve element 106 to equalize with the portion of central flow passageway 30 up-hole from ball-valve element 106. This can prevent fluid pressure from up-hole forcing ball-valve element 106 out of its second rotative state.

If the predetermined longitudinal force is again applied to mandrel 24, then ring 68 again rotates due to interaction action of lug 70 and upper surface 64. When the force is released, lug 70 will now contact a section of lower surface 66 that slopes down to straight leg section 60. Accordingly, ring 68 will rotate due to interaction of lug 70 and lower surface 66 until lug 70 enters straight leg section 60. At this point, spring 78 will be able to return mandrel 24 to its uppermost position relative to sleeve 51 allowing ball-valve element 106 to also move up and simultaneously rotate back to its first rotative position. It will be appreciated that the embodiments described herein move the ball-valve between a position allowing fluid flow and a position preventing fluid flow with only longitudinal movement (axial movement) of the mandrel and without rotational movement of the mandrel.

Figure 15:
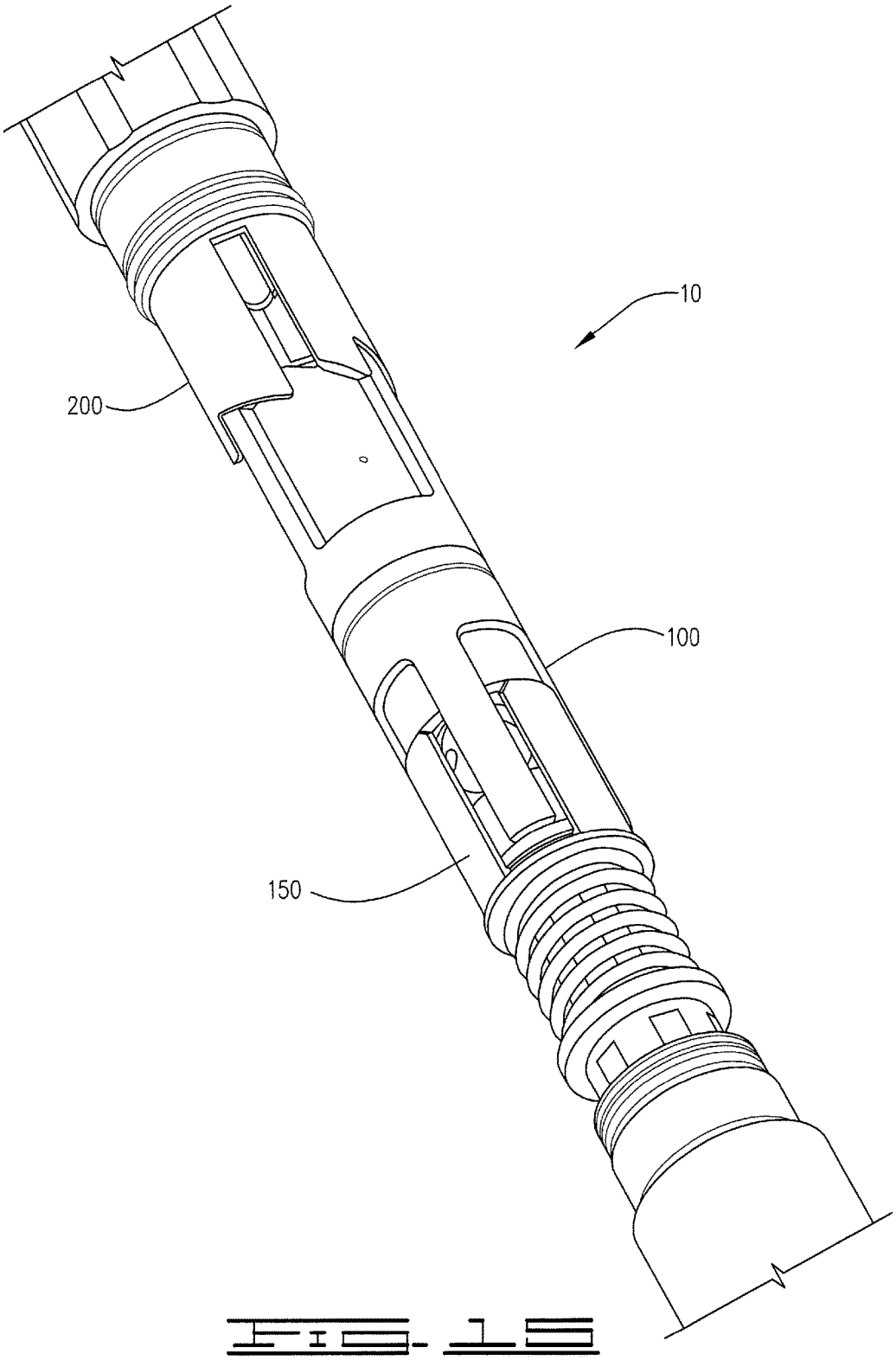
FIG. 15 is an isometric schematic view of a second embodiment of the ball-valve system. The ball-valve-system portion of the down-hole tool is shown without the outer sleeve.
Figure 16:
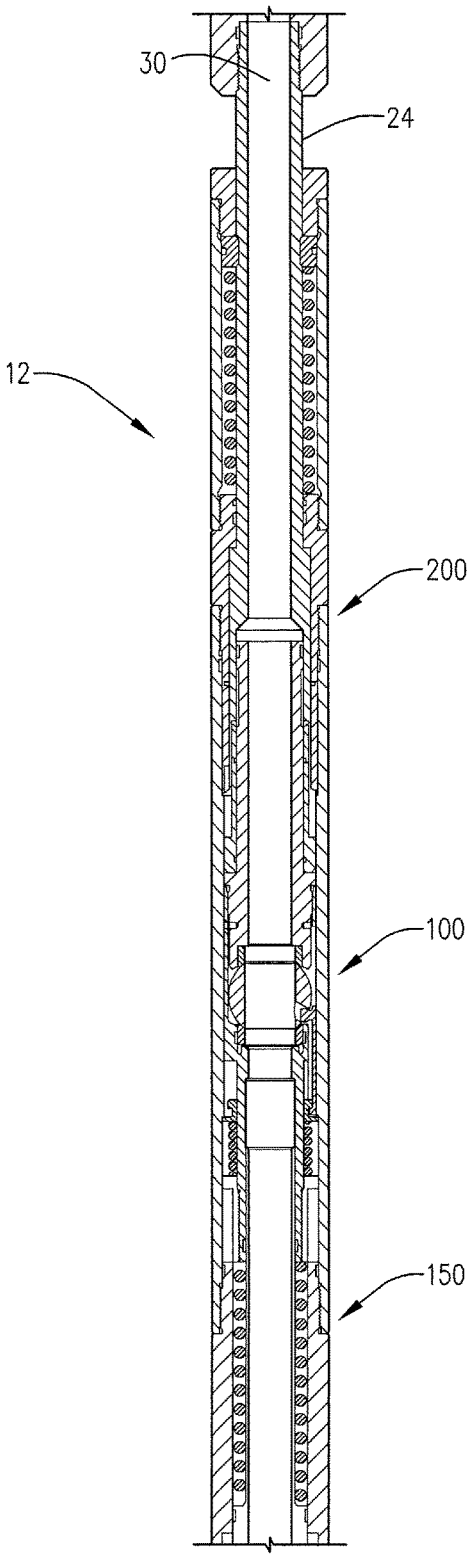
FIG. 16 is a cross-sectional schematic view of a ball-valve system in accordance with the second embodiment.
Figure 17:
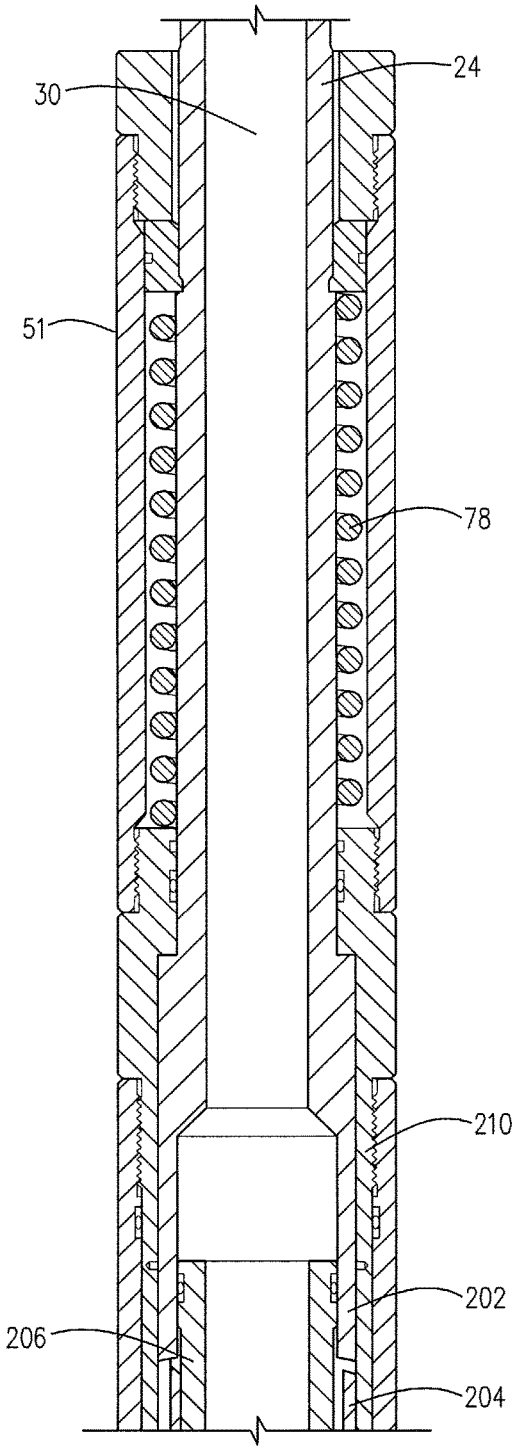
FIG. 17 is an enlargement of the actuator section of the ball-valve system of FIG. 16.
Figure 18:
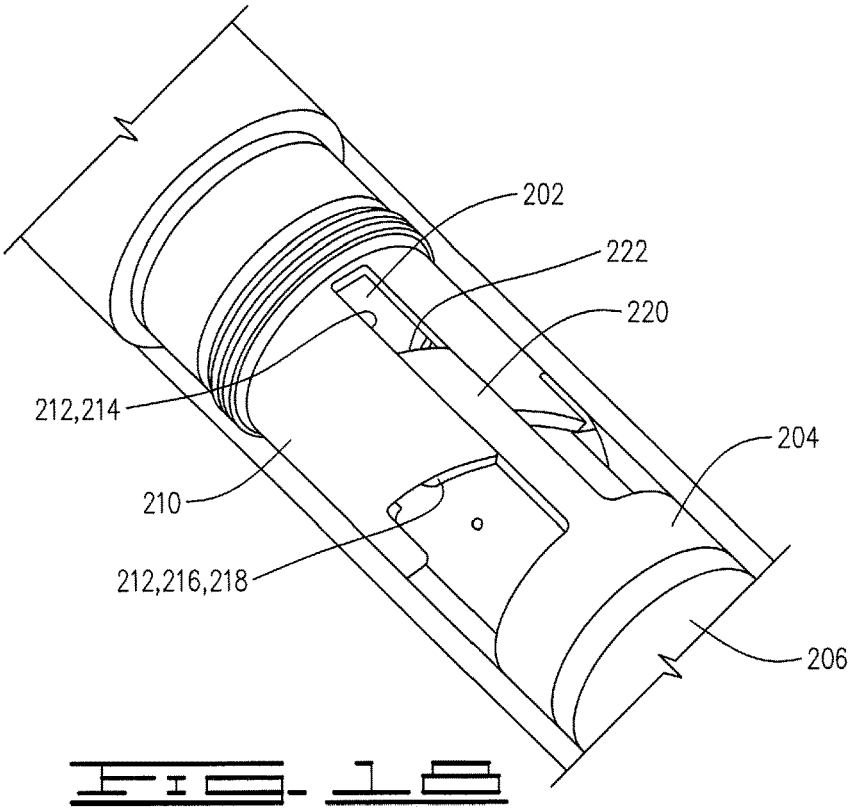
FIGS. 18, 19, 20 and 21 are isometric figures illustrating the movement of the actuating section of the ball-valve system of FIG. 16. The actuating section is shown without the outer sleeve.

Turning now to FIGS. 15-24, a second embodiment of the ball-valve system 12 is illustrated. FIG. 15 illustrates an isometric view of the ball-valve system 12 and FIG. 16 illustrates a cross-sectional view. Like the previous embodiment, ball-valve system 12 of FIGS. 15 and 16 has an actuator section 200, a ball-valve section 100 and a balancing piston section 150. Ball-valve section 100 and balancing piston section 150 are substantially as described above.

Turning now to FIGS. 17-24, the actuator system 200 is illustrated. The actuator system 200 comprises a portion of mandrel 24 and an outer sleeve 51. Outer sleeve 51 is positioned concentrically about mandrel 24. Mandrel 24 and outer sleeve 51 are in sliding relation so that an axial force on mandrel 24 will cause it to slide longitudinally in relation to outer sleeve 51. Further, this sliding relation is resilient due to spring elements.

Mandrel 24 terminates in a prod member 202. Prod member 202 has a lower angled surface 203, which contacts a ring 204 when mandrel 24 is in its uppermost position relative to sleeve 51. Ring 204 is sandwiched between and is in sliding relation with a second mandrel 206. Second mandrel 206 is in sliding relation with outer sleeve 51 and is in sealing contact with ball-valve element 106 by means of first ball seat 108. Accordingly, downward force on mandrel 24 causes it to slide down-hole and transfers the force via prod member 202 to ring 204. Ring 204 in response moves down-hole pushing against a shoulder 208 of second mandrel 206, which in turn moves down-hole and pushes against ball-valve element 106. As can be seen from FIG. 17, a spring 78 biases mandrel 24 towards an uppermost position relative to mandrel 51, as previously described.

Actuator section 200 further comprises a tubular member 210, which is fixedly secured to outer sleeve 51. As can best be seen from FIG. 18-21, tubular member 210 has a channel 212 formed from a straight leg section 214 and a circumferential section 216. Straight leg section 214 extends substantially longitudinally along the surface of tubular member 210. Circumferential section 216 extends circumferentially about tubular member 210. In this embodiment, circumferential section 216 consists of only upper surface 218. Upper surface 218 has a saw tooth configuration.

Ring 204 can both longitudinally move and can rotate about the longitudinal axis of down-hole tool 10. Ring 204 has an upper ring surface 218 that is saw tooth in shape, as best seen from FIG. 19. Ring 204 has a lug 220 extending upward along its outer surface to interact with channel 212. Lug 220 has an upper angled surface 222, which forms a part of upper ring surface 218.

When mandrel 24 slides longitudinally, down-hole relative to outer sleeve 51, spring 78 is compressed; thus, mandrel 24 is biased in an up-hole direction. As can be seen from FIG. 18, when lug 220 is positioned in straight leg section 214 and no axial force is applied to mandrel 24, lug 220 will be in the uppermost position of straight leg section 214 and upper angled surface 220 will be in contact with lower angled surface 203 of prod member 202 due to the biasing effect of spring 156.

Figure 19:
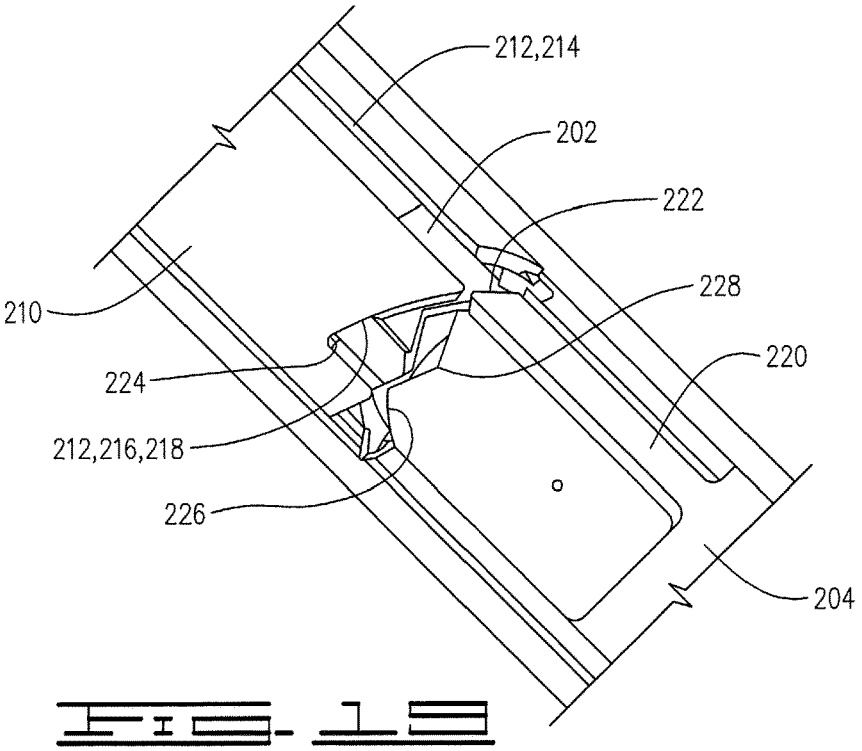
Figure 20:
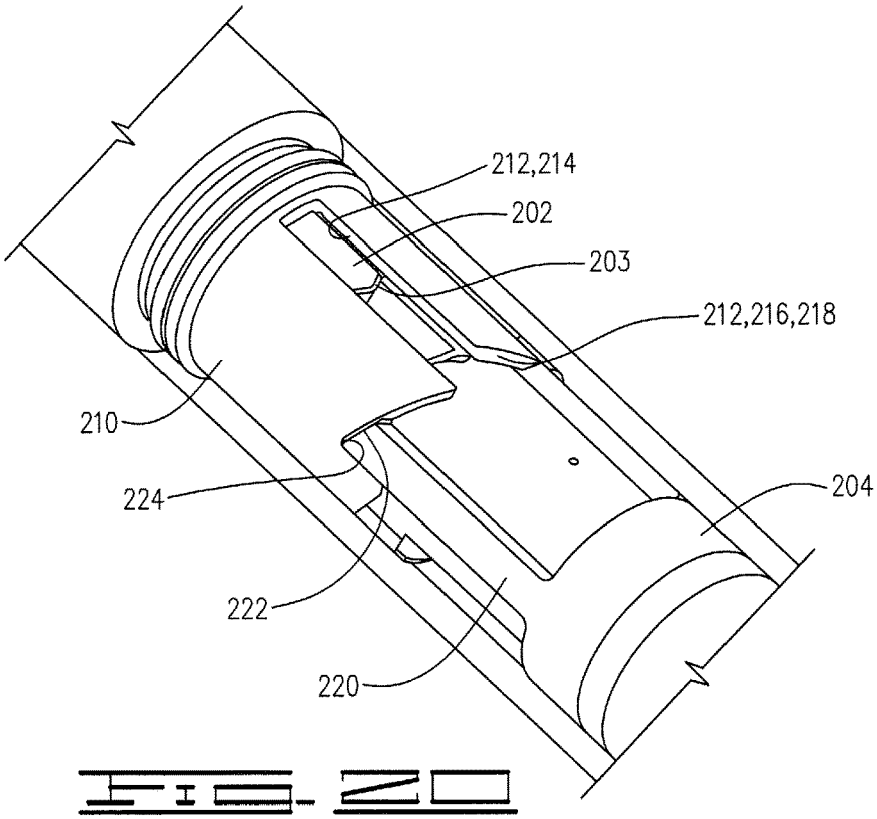
Figure 21:
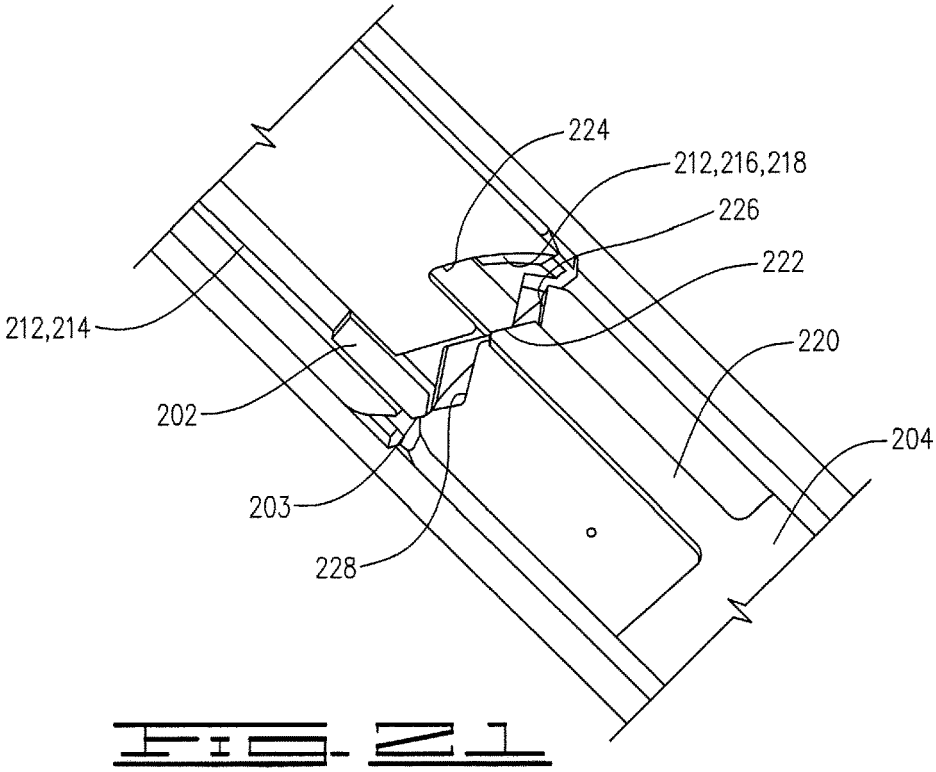

When sufficient axial force is applied to mandrel 24, mandrel 24 will slide longitudinally down-hole and prod member 202 will push ring 204; thus, moving lug 220 downward until it is adjacent to upper surface 218, as shown in FIG. 19. Due to the angles on lower angled surface 203 and upper angled surface 222, ring 204 will rotate. The rotation places upper angled 222 of lug 220 in contact with upper surface 218. Prod member 202 comes in contact with a trough 228 in upper ring surface 226. Upon release of the axial force, prod member 202 moves upwards allowing ring 204 to move upward. Because of the contact between the upper angled surface 222 of lug 220 and upper surface 218, ring 204 is further rotated until upper angled surface 222 is in a crest 224 of upper surface 218, as shown in FIG. 20. Thus, ring 204 is locked in position until another axial force of sufficient magnitude is applied to mandrel 24. When such an axial force is applied, prod member 202 will come into contact with upper ring surface 226 and push ring 204 downward until lug 220 is free from crest 224, as shown in FIG. 21. Ring 204 will then rotate due to the interaction of lower angled surface 203 of prod member 202 with the saw tooth surface of upper ring surface 226. The rotation repositions lug 220 to a portion of upper surface 218 that is angled toward straight leg section 214. When the axial force is released, lug 220 will be directed to enter straight leg section 214 by the interaction of upper surface 222 of lug 220 with upper surface 218.

Figure 22:
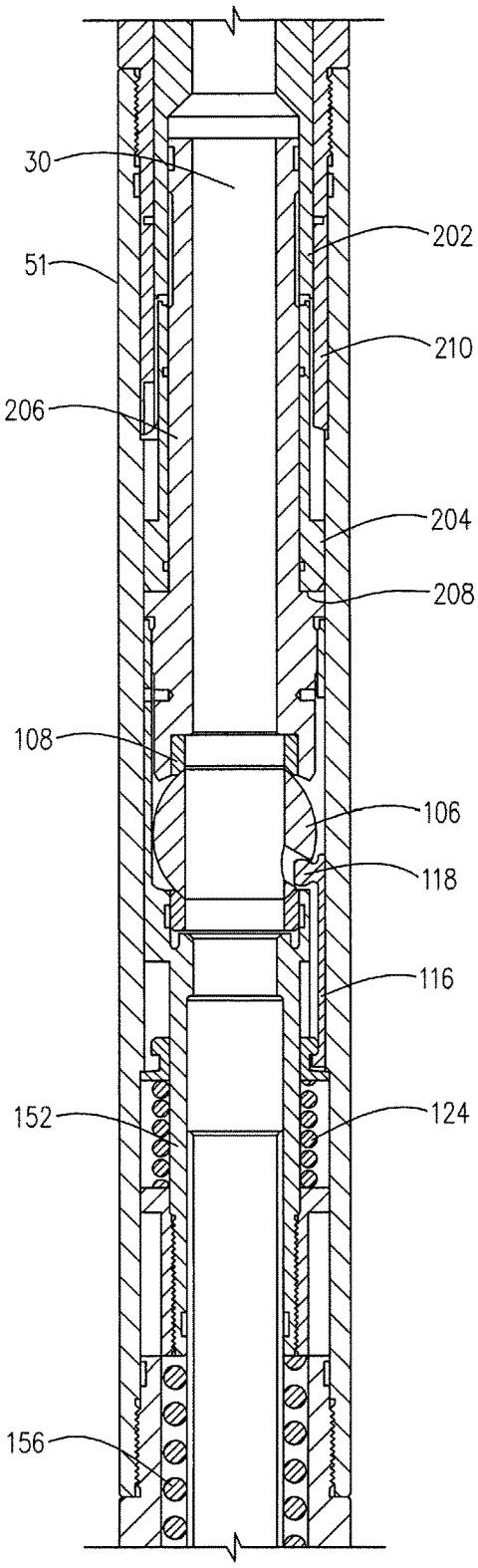
FIGS. 22, 23 and 24 are cross-sectional figures illustrating the interaction of the actuator section and ball-valve section of the ball-valve system of FIG. 16.
Figure 23:
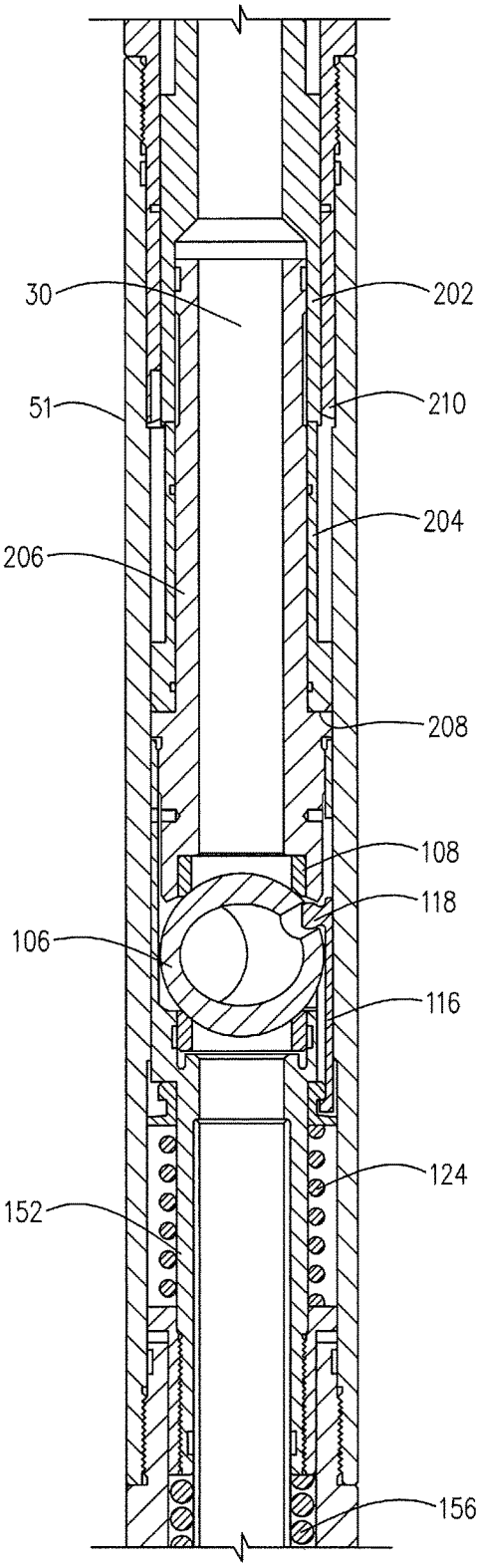
Figure 24:
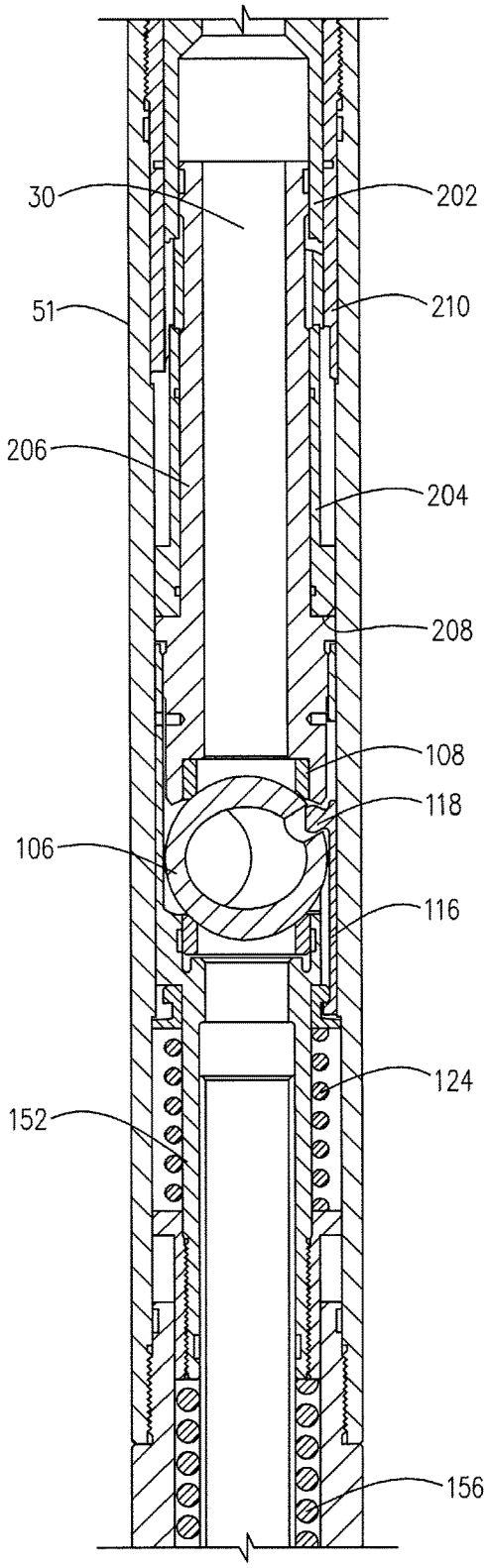

The operation of the ball-valve element can be seen from FIGS. 22 to 24. Its operation is substantially as described above for the first embodiment, except that second mandrel 206 is in contact with ball-valve element 106 instead of mandrel 24.

As will be realized from the above disclosure, the disclosed ball-valve system provides for opening and closing the ball valve with only up and down movement of the mandrel and of the tubing connected to the mandrel's up-hole end. By eliminating the rotation of the tubing, the ball-valve system can provide a better and easier method to open and close a ball valve in a highly deviated well bore than provided by the use of ball valves relying on rotational movement of the tubing string to move between open and closed positions.

In accordance with the above disclosure, various embodiments are now further described. In a first embodiment, a ball-valve system for use in a well casing is provided. The ball-valve system comprises a mandrel, a ball valve and an actuator. The mandrel defines a flow passageway extending longitudinally along a central axis of the mandrel. The ball valve is disposed within the mandrel. The ball valve includes a generally spherically shaped ball-valve element with a flow opening. The ball-valve element has a first rotative position in which the flow opening is aligned with the flow passageway thus allowing flow through the flow passage, and a second rotative position in which the flow opening is transverse to the flow passageway thus preventing flow through the flow passageway. The actuator comprises a tubular member and a ring. The ring engages the tubular member in a sliding relation relationship such that the tubular member and ring have an actuating movement. The actuating movement is a predetermined amount of relative longitudinal movement between the tubular member and the ring sufficient to move the ball-valve element between the first rotative position and the second rotative position. The actuating movement results in relative rotational movement of the tubular member and the ring. The relative rotational movement moves the ball-valve system between a first state in which the ball-valve element is locked in the first rotative position and a second state in which the ball-valve element is locked in the second rotative position. Generally, the actuator moves the ball-valve element between the first rotational position and second rotational position without rotational movement of the mandrel.

In another embodiment, the ring can have a lug that travels in a channel of the tubular member. The channel comprises a straight longitudinal section and a circumferential section. The application and release of axial force moves the lug between the straight leg section and the circumferential section. The circumferential section can have an up-hole surface and a down-hole surface. In this embodiment, when the lug is in the straight longitudinal section, application of axial force on the tubular member causes the actuation movement, which places the lug in contact with the up-hole surface. This contact results in the relative rotational movement such that release of the axial force places the lug in contact with the down-hole surface. The contact with the down-hole surface locks the ball-valve element into the second rotative position. When the lug is in contact with the down-hole surface, application of axial force on the tubular member causes the actuation movement, which places the lug in contact with the up-hole surface. Contact with the up-hole surface results in the relative rotational movement such that release of the axial force places the lug into the straight longitudinal section such that the ball-valve element is locked into the first rotative position. The tubular member can form part of the mandrel and the application of axial force can be on the mandrel.

In a further embodiment, the circumferential section has an up-hole surface. The ring has an angled upper surface and further comprises a prod member with an angled lower surface. In this embodiment, when the lug is in the straight longitudinal section, application of axial force on the prod member causes the lower angled surface of the prod member to interact with a portion of the upper angled surface of the ring on the lug. This interaction causes the actuation movement and the relative rotational movement such that the lug is placed into contact with the up-hole surface of the circumferential section to lock the ball-valve element in the second rotative position. When the lug is in contact with the up-hole surface, application of axial force on the prod member causes the lower angled surface of the prod member to interact with the upper angled surface of the ring. The interaction with the upper angled surface causes the actuation movement and relative rotational movement such that the lug is moved from contact with the up-hole angled surface into the straight longitudinal section to lock the ball-valve element in the first rotative position. The prod member can be part of the mandrel and the application of axial force can be on the mandrel.

Additionally, the ball valve system of the above embodiments can further comprise a first spring disposed around the mandrel such that the first spring biases the relative longitudinal movement of the ring and the tubular member such that the lug is biased in an up-hole direction.

The ball valve systems of the above embodiments can further comprise a balancing piston positioned down-hole of the ball valve. The balancing piston resiliently provides pressure to the ball-valve element to counteract fluid pressure in the flow passageway down-hole from the ball-valve element to thus prevent the fluid pressure from moving the ball-valve element from the second rotative position.

The ball-valve system of the above embodiment can also comprise an operating arm slidingly engaging the balancing piston and an outer sleeve. The operating arm and ball-valve element are attached so that the operating arm resiliently moves the ball-valve element between the first rotative position and the second rotative position in response to the relative axial movement of the ring and tubular member. Further, the operating arm can have a lug and be attached to the ball-valve element by positioning the lug in an orifice in the ball-valve element.

In addition, in the above embodiments the ball-valve element has an interior chamber such that, in the second rotative position, the interior chamber can be in fluid flow communication to a portion of the flow passageway up-hole from the ball valve when an up-hole pressure in the flow passageway above the ball valve exceeds a down-hole pressure in the flow passageway below the ball valve.

In a further embodiment, a method of operating down-hole tool having a ball valve in a well bore is provided. The method comprises:

introducing the down-hole tool into the well bore;

moving a ring and a tubular member longitudinally relative to each other, wherein the ring and the tubular member are in sliding relationship to each other;

moving the ball valve between a first rotative and a second rotational position in reaction to the longitudinal movement of the ring and tubular member, wherein the first rotative position allows flow through a flow passageway of the down-hole tool and the second rotative position prevents flow through the flow passageway; and moving the ring and the sleeve rotationally relative to each other, wherein the relative rotational movement of the tubular member and the ring moves the down-hole tool between a first state in which the ball valve is not locked in the second rotative position and a second state in which the ball valve is locked in the second rotative position.

In some embodiments, the ring has a lug that travels in a channel of the tubular member. In these embodiments, the method further comprises applying axial force to cause the relative longitudinal movement and the relative rotational movement such that the lug is moved between a straight leg section of the channel and a circumferential section of the channel.

In a portion of the embodiments using the lug and channel, the method further comprises:

applying a first axial force so as to cause the relative longitudinal movement such that the lug is moved along a straight leg section of the channel and placed in contact with an up-hole surface of a circumferential section of the channel such that the contact with the up-hole surface results in the relative rotational movement, wherein the relative longitudinal movement moves the ball-valve element from the first rotative position to the second rotative position;

releasing the first axial force such that the lug comes into contact with a down-hole surface of the circumferential section such that the ball-valve element is locked into the second rotative position;

applying a second axial force so as to cause the relative longitudinal movement such that the lug is moved from contact with the down-hole surface and placed in contact with an up-hole surface such that the contact with the up-hole surface results in the relative rotational movement; and releasing the second axial force such that the lug enters the straight leg section and the ball-valve element is moved into the second rotative position.

In another portion of the embodiments using the lug and channel, the circumferential section has an up-hole surface, the ring has an angled surface with a portion of the angled upper surface being on the lug, and the method further comprises:

applying a first axial force on the prod member such that an angled surface of the prod member to interact with the portion of the angled surface of the ring so as to cause the relative longitudinal movement such that a lug on the ring travels in a straight leg channel on the tubular member, wherein the relative longitudinal movement moves the ball valve from the first rotative position to the second rotative position, and when the portion of the angled surface on the lug is aligned with an angled surface on the tubular member, the angled surface of the prod and the angled surface of the ring cause relative rotational movement placing the portion of the angled surface on the ring in contact with the angled surface of the tubular member;

releasing the first axial force such that the lug is in locked contact with the angled surface of the tubular member thus locking the ball valve into the second rotative position;

applying a second axial force on the prod member such that the angled surface of the prod member interacts with the angled surface of the ring so as to disengage the lug from locked contact with the angled surface of the tubular member so as to cause the relative rotational movement and align the lug with the straight leg channel; and releasing the second axial force on the prod member such that the lug travels into the straight line channel with the ring and tubular member undergoing the relative longitudinal movement, which moves the ball valve from the second rotative position to the first rotative position.

Further embodiments of the method can comprise resiliently providing pressure, typically from one or more springs, to the ball valve to counteract fluid pressure in the flow passageway down-hole from the ball valve. Thus, this counteracting pressure prevents the ball valve from moving out of the second rotative position due to the down-hole fluid pressure. Also, the ball valve can resiliently move between the first rotative position and the second rotative position in response to the relative axial movement of the ring and tubular member by an operating arm attached to the ball valve. Also, the operating arm can have a lug, which is attached to the ball valve by positioning the lug in an orifice in the ball valve. In addition, in the above embodiments the ball-valve element can have a flow opening such that, in the first rotative position, the interior flow opening can be in fluid flow communication to a portion of the flow passageway up-hole from the ball valve when an up-hole pressure in the portion of flow passageway up-hole from the ball valve exceeds a down-hole pressure in a portion of the flow passageway down-hole from the ball valve.

Other embodiments will be apparent to those skilled in the art from a consideration of this specification or practice of the embodiments disclosed herein. Thus, the foregoing specification is considered merely exemplary with the true scope thereof being defined by the following claims.

What is claimed is:

1. A valve system for use in a well casing, the valve system comprising:

a mandrel defining a flow passageway extending longitudinally along a central axis of the mandrel;

a valve disposed within the mandrel, wherein the valve has a first position in which flow through the flow passage is allowed, and a second position in which the flow through the flow passageway is prevented;

an actuator comprising:

a tubular member;

a ring which engages the tubular member in a sliding relationship such that the tubular member and ring have an actuating movement, wherein the actuating movement is a predetermined amount of relative longitudinal movement between the tubular member and the ring sufficient to move the valve between the first position and the second position, and wherein the movement of the valve between the first position and the second position only occurs when the actuating movement results in relative rotational movement of the tubular member and the ring, and relative rotational movement of the tubular member and ring does not occur without the actuating movement, thus resulting in the valve system having a first state in which the valve is locked in the first position and a second state in which the valve is locked in the second position.

2. The valve system of claim 1, wherein:

the valve is a ball valve disposed within the mandrel, the ball valve including a generally spherically shaped ball-valve element with a flow opening, wherein the ball-valve element has a first rotative position in which the flow opening is aligned with the flow passageway thus allowing flow through the flow passage, and a second rotative position in which the flow opening is transverse to the flow passageway thus preventing flow through the flow passageway;

the actuating movement is a predetermined amount of relative longitudinal movement between the tubular member and the ring sufficient to move the ball-valve element between the first rotative position and the second rotative position;

in the first state, the ball-valve element is locked in the first rotative position; and in the second state, the ball-valve element is locked in the second rotative position.

3. The valve system of claim 2, wherein the ring has a lug that travels in a channel of the tubular member, the channel comprising:

a straight longitudinal section; and a circumferential section and wherein application and release of axial force moves the lug between the straight longitudinal section and the circumferential section.

4. The valve system of claim 3, wherein the circumferential section has an up-hole surface and a down-hole surface, and wherein:

when the lug is in the straight longitudinal section, application of axial force on the tubular member causes the actuation movement which places the lug in contact with the up-hole surface resulting in the relative rotational movement such that release of the axial force places the lug in contact with the down-hole surface such that the ball-valve element is locked into the second rotative position; and when the lug is in contact with the down-hole surface, application of axial force on the tubular member causes the actuation movement which places the lug in contact with the up-hole surface resulting in the relative rotational movement such that release of the axial force places the lug into the straight longitudinal section such that the ball-valve element is locked into the first rotative position.

5. The valve system of claim 4, further comprising a first spring disposed about the mandrel such that the first spring biases the relative longitudinal movement of the ring and the tubular member such that the lug is biased in a down-hole direction.

6. The valve system of claim 5, wherein the tubular member forms part of the mandrel and the application of axial force is on the mandrel.

7. The valve system of claim 2, further comprising a balancing piston positioned down-hole of the ball valve and which resiliently provides pressure to the ball-valve element to counteract fluid pressure in the flow passageway down-hole from the ball-valve element to thus prevent the fluid pressure from moving the ball-valve element from the second rotative position.

8. The valve system of claim 7, further comprising an operating arm slidingly engaging the balancing piston and an outer sleeve, wherein the operating arm is attached to the ball-valve element to resiliently move the ball-valve element between the first rotative position and the second rotative position in response to the relative axial movement of the ring and tubular member.

9. The valve system of claim 8, wherein the operating arm has a lug and is attached to the ball-valve element by positioning the lug in an orifice in the ball-valve element.

10. The valve system of claim 8, in the second rotative position, the flow opening is in fluid flow communication to a portion of the flow passageway up-hole from the ball valve when an up-hole pressure in the flow passageway above the ball valve exceeds a down-hole pressure in the flow passageway below the ball valve.

11. A valve system for use in a well casing, the valve system comprising:

a mandrel defining a flow passageway extending longitudinally along a central axis of the mandrel;

a ball valve disposed within the mandrel, the ball valve including a generally spherically shaped ball-valve element with a flow opening, wherein the ball valve has a first rotative position in which the flow opening is aligned with the flow passageway thus allowing flow through the flow passage, and a second rotative position in which the flow opening is transverse to the flow passageway thus preventing flow through the flow passageway;

an actuator comprising:

a tubular member;

a ring which engages the tubular member in a sliding relationship such that the tubular member and ring have an actuating movement, which is a predetermined amount of relative longitudinal movement between the tubular member and the ring sufficient to move the ball-valve element between the first rotative position and the second rotative position, and wherein the actuating movement results in relative rotational movement of the tubular member and the ring, which moves the valve system between a first state in which the valve is locked in the first rotative position and a second state in which the valve is locked in the second rotative position;

wherein the ring has a lug that travels in a channel of the tubular member, the channel comprising:

a straight longitudinal section; and a circumferential section and wherein application and release of axial force moves the lug between the straight longitudinal section and the circumferential section;

wherein the circumferential section has an up-hole surface, the ring has an angled upper surface and further comprising a prod member with an angled lower surface, and wherein:

when the lug is in the straight longitudinal section, application of axial force on the prod member causes the lower angled surface of the prod member to interact with a portion of the upper angled surface of the ring on the lug to cause the actuation movement and to cause relative rotational movement such that the lug is placed into contact with the up-hole surface of the circumferential section so as to lock the ball-valve element in the second rotative position; and when the lug is in contact with the up-hole surface, application of axial force on the prod member causes the lower angled surface of the prod member to interact with the upper angled surface of the ring to cause the actuation movement and to cause relative rotational movement such that the lug is moved from contact with the up-hole angled surface into the straight longitudinal section so as to lock the ball-valve element in the first rotative position.

12. The valve system of claim 11, further comprising a first spring disposed around the mandrel such that the first spring biases the relative longitudinal movement of the ring and the tubular member such that the lug is biased in an up-hole direction.

13. The valve system of claim 12, wherein the prod member is part of the mandrel and the application of axial force is on the mandrel.

14. A method of operating a down-hole tool having a ball valve in a well bore, the method comprising:

introducing the down-hole tool into the well bore;

moving a ring and a tubular member longitudinally and rotationally relative to each other, wherein the ring and the tubular member are in sliding relationship to each other such that there is an actuating movement that is a predetermined amount of relative longitudinal movement between the tubular member and the ring, and rotation of the ring relative to the tubular member does not occur without the actuating movement;

moving the ball valve between a first rotative position and a second rotative position in reaction to the actuating movement, wherein movement of the valve between the first position and the second position only occurs when the actuating movement results in relative rotational movement of the tubular member and the ring, and wherein the first rotative position allows flow through a flow passageway of the down-hole tool and the second rotative position prevents flow through the flow passageway; and wherein the actuating movement moves the down-hole tool between a first state in which the ball valve is not locked in the second rotative position and a second state in which the ball valve is locked in the second rotative position.

15. The method of claim 14, wherein the ring has a lug that travels in a channel of the tubular member, and the method further comprises applying axial force to cause the relative longitudinal movement and the relative rotational movement such that the lug is moved between a straight leg section of the channel and a circumferential section of the channel.

16. The method of claim 15, wherein the method further comprises:

applying a first axial force to cause the relative longitudinal movement such that the lug is moved along the straight leg section of the channel and placed in contact with an up-hole surface of the circumferential section of the channel such that the contact with the up-hole surface results in the relative rotational movement, wherein the relative longitudinal movement moves the ball-valve element from the first rotative position to the second rotative position;

releasing the first axial force such that the lug comes into contact with a down-hole surface of the circumferential section such that the ball-valve element is locked into the second rotative position;

applying a second axial force so as to cause the relative longitudinal movement such that the lug is moved from contact with the down-hole surface and placed in contact with an up-hole surface such that the contact with the up-hole surface results in the relative rotational movement; and releasing the second axial force such that the lug enters the straight leg section and the ball-valve element is moved into the first rotative position.

17. The method of claim 14, further comprising resiliently providing pressure to the ball valve to counteract fluid pressure in the flow passageway down-hole from the ball valve to thus prevent the ball valve from moving out of the second rotative position due to the fluid pressure.

18. The method of claim 17, wherein the ball valve is resiliently moved between the first rotative position and the second rotative position in response to the relative axial movement of the ring and tubular member by an operating arm attached to the ball valve.

19. The method of claim 18, wherein the operating arm has a lug and is attached to the ball valve by positioning the lug of the operating arm in an orifice in the ball valve.

20. A method of operating a down-hole tool having a ball valve in a well bore, the method comprising:

introducing the down-hole tool into the well bore;

moving a ring and a tubular member longitudinally relative to each other, wherein the ring and the tubular member are in sliding relationship to each other;

moving the ball valve between a first rotative position and a second rotative position in reaction to the longitudinal movement of the ring and tubular member, wherein the first rotative position allows flow through a flow passageway of the down-hole tool and the second rotative position prevents flow through the flow passageway; and moving the ring and the sleeve rotationally relative to each other, wherein the relative rotational movement of the tubular member and the ring moves the down-hole tool between a first state in which the ball valve is not locked in the second rotative position and a second state in which the ball valve is locked in the second rotative position;

wherein the ring has a lug that travels in a channel of the tubular member, and the method further comprises applying axial force to cause the relative longitudinal movement and the relative rotational movement such that the lug is moved between a straight leg section of the channel and a circumferential section of the channel;

wherein the circumferential section has an up-hole surface, the ring has an angled surface with a portion of the angled upper surface being on the lug, and wherein the method further comprises:

applying a first axial force on a prod member such that an angled surface of the prod member interacts with the portion of the angled surface of the ring to cause the relative longitudinal movement such that the lug on the ring travels in the straight leg section of the channel on the tubular member, wherein the relative longitudinal movement moves the ball valve from the first rotative position to the second rotative position, and when the portion of the angled surface on the lug is aligned with an angled surface on the tubular member, the angled surface of the prod and the angled surface of the ring cause relative rotational movement placing the portion of the angled surface on the ring in contact with the angled surface of the tubular member;

releasing the first axial force such that the lug is in locked contact with the angled surface of the tubular member thus locking the ball valve into the second rotative position;

applying a second axial force on the prod member such that the angled surface of the prod member interacts with the angled surface of the ring to disengage the lug from locked contact with the angled surface of the tubular member so as to cause the relative rotational movement and align the lug with the straight leg section of the channel; and releasing the second axial force on the prod member such that the lug travels into the straight leg section of the channel with the ring and tubular member undergoing the relative longitudinal movement, which moves the ball valve from the second rotative position to the first rotative position.

* * * * *